US011215371B2

(12) United States Patent
O'Brian

(10) Patent No.: US 11,215,371 B2
(45) Date of Patent: Jan. 4, 2022

(54) VARIABLE REFRIGERANT FLOW (VRF) DEHUMIDIFICATION SYSTEM

(71) Applicant: Hussmann Corporation, Bridgeton, MO (US)

(72) Inventor: John O'Brian, Hammond, LA (US)

(73) Assignee: Hussmann Corporation, Bridgeton, MO (US)

( * ) Notice: Subject to any disclaimer, the term of this patent is extended or adjusted under 35 U.S.C. 154(b) by 93 days.

(21) Appl. No.: 16/511,382

(22) Filed: Jul. 15, 2019

(65) Prior Publication Data

US 2019/0338965 A1 Nov. 7, 2019

Related U.S. Application Data

(60) Provisional application No. 62/699,055, filed on Jul. 17, 2018.

(51) Int. Cl.
*F24F 3/14* (2006.01)
*F25B 49/02* (2006.01)

(52) U.S. Cl.
CPC ..... *F24F 3/14* (2013.01); *F25B 49/027* (2013.01); *F24F 2003/1446* (2013.01); *F25B 2600/2513* (2013.01)

(58) Field of Classification Search
CPC ..... F24F 1/0083; F24F 3/14; F24F 2003/144; F24F 2003/1446; F25B 49/027; F25B 2600/2513
See application file for complete search history.

(56) References Cited

U.S. PATENT DOCUMENTS

2006/0086112 A1* 4/2006 Bloemer ..... F24F 3/153 62/176.6
2007/0205294 A1* 9/2007 Byczynski ..... F24F 13/082 236/440
2009/0192650 A1* 7/2009 Tonner ..... G05D 27/02 700/276
2013/0091874 A1 4/2013 Sillato et al.
2016/0161163 A1 6/2016 Hung
(Continued)

FOREIGN PATENT DOCUMENTS

WO WO-2015084049 A1 * 6/2015 ..... B01D 53/06

*Primary Examiner* — Jonathan Bradford
(74) *Attorney, Agent, or Firm* — Michael Best & Friedrich LLP

(57) ABSTRACT

A Variable Refrigerant Flow (VRF) dehumidification system. The system has at least one condenser module in fluid communication with one or more indoor air handlers. At least one evaporator coil is in fluid communication with the indoor air handlers and at least one reheat/reclaim coil. The evaporator and reheat/reclaim coils are also in communication with the condenser module. A plurality of electronic expansion valves (EEVs) are in fluid communication with the indoor air handlers. A plurality of sensors is disposed in the system and are in communication with at least one VRF dehumidification system controller. In one embodiment, a logic is stored in a non-transitory computer readable medium that, when executed by one or more processors, causes the VRF dehumidification system to monitor the data input from the plurality of sensors and regulates the capacity of the VRF dehumidification system needed to maintain a set dew point parameter.

1 Claim, 4 Drawing Sheets

(56) References Cited

U.S. PATENT DOCUMENTS

| | | | |
|---|---|---|---|
| 2017/0138619 | A1 | 5/2017 | Sprayberry et al. |
| 2017/0176056 | A1 | 6/2017 | Eicher et al. |
| 2017/0191715 | A1 | 7/2017 | Yang et al. |

* cited by examiner

VARIABLE REFRIGERANT FLOW (VRF) DEHUMIDIFICATION SYSTEM

CROSS REFERENCE TO RELATED APPLICATIONS

This application claims the benefit of U.S. Provisional Application No. 62/699,055 filed on Jul. 17, 2018. The above identified patent application is herein incorporated by reference in its entirety to provide continuity of disclosure.

BACKGROUND OF THE INVENTION

The present invention relates to dehumidification air processing systems. More particularly, the present invention provides for a VRF dehumidification air processing system with a plurality of sensors and coils.

Sweltering temperatures and high humidity are not only uncomfortable for people but may also contribute to deterioration of buildings. Some people are able to tolerate high temperatures as long as the humidity is not also excessive. Most people find that high temperatures mixed with high humidity results in them feeling sluggish and unable to carry on physically without relief. In such conditions people typically sweat, which is the body's natural mechanism to reduce the body's temperature. Excessive sweating is undesirable as it is uncomfortable to the individual, and may produce unsightly marks on the individual's clothing, or undesirable smells.

Buildings also suffer from high temperatures mixed with high humidity. As discussed, the people inside the building may feel uncomfortable, but such conditions also promote mold growth in the walls and can compromise the structural integrity of the building. Grocery stores, in particular, are especially careful to maintain a low humidity in the building in order to reduce spoilage of food and fresh produce exposed to the air. Dry foods can draw in moisture from the air and are especially prone to spoilage in such conditions.

Heating, ventilation, and air conditioning (HVAC) systems attempt to combat rising temperatures via chemical refrigerants. HVAC systems installed in a building operate by passing indoor air through a refrigeration cycle. A chemical refrigerant in a gaseous state starts the refrigeration cycle in a compressor. The compressor increases the pressure and temperature of the refrigerant. The refrigerant is then passed into a heat exchanger, or "condensing coil", where heat from the superheated and compressed gaseous refrigerant is bled off to the outside air thereby cooling the refrigerant. When the refrigerant cools it condenses back into a liquid phase. In some circumstances, an expansion valve is utilized to regulate the amount of liquid refrigerant which is passed through to the heat exchangers. The expansion valve decreases the pressure of the cooled liquid refrigerant and the refrigerant is then passed to another heat exchanger. Air from inside the building is passed over the cooled liquid refrigerant and as the building's inside air is warmer than the cooled liquid refrigerant, heat is transferred from the inside air to the refrigerant. As the liquid refrigerant heats back up, it travels back into the compressor where it transitions back to a gaseous state and the cycle is completed and started anew.

Although a typical HVAC system is able to cool a building through utilization of the refrigeration cycle, such systems are unable to fine-tune and maintain constant temperatures. After a target temperature is selected by a user, the HVAC system operates either at full-force or not at all. In this manner, the HVAC works to cool the building to the target temperature, and once that target temperature is achieved, the HVAC turns off. This results in a constant overshooting, where either the target temperature is achieved and then exceeded because of the delay between the system recognizing that the air has achieved the targeted temperature and the cessation of the system, or after the HVAC is turned off the temperature begins diverge from the targeted temperature, thereby resulting in the target temperature not being maintained. This constant on/off cycle also does not lend itself to dehumidification as dehumidification of a building requires the HVAC system to be on for an extended period of time in order to allow moisture from the air to condense and be pumped outside of the building. Where the HVAC is constantly turning on and off, the moisture is not given enough time to accumulate and be transferred out of the building.

Variable Refrigerant Flow (VRF) systems are air conditioning systems where there is either one outdoor condensing unit, or multiple condensing units acting as one, as well as multiple indoor air handlers which incorporate an inverter into the compressor to allow for variable motor speeds. Such variable speeds allow for a variable refrigerant flow instead of the on/off flow as can be found in traditional HVAC systems. VRF systems continually adjust the flow of refrigerant into each of the indoor air handler units. In some versions, the amount of refrigerant is controlled by a microprocessor receiving information from sensors throughout the system.

VRF systems provide the benefit of allowing for multiple zones of heating and cooling through the use of the indoor air handlers. VRF systems fall into two main categories; Heat Pump systems and Heat Recovery systems. A Heat Pump system consists of an outdoor condensing unit, air handlers in the form of cassettes, distribution Wyes, optional wall-mounted thermostats, and an optional system controller. Such a system typically requires that all zones are either all operating in a heating mode, or a cooling mode as VRF systems can only handle one mode of heating or cooling at a time. The Heat Pump system collects data from four points of the system; two points are located at the indoor evaporator coil sensors which are utilized for calculations performed in utilization of an Electronic Expansion Valve (EEV), one point is from a sensor located within the return air, and the final point from a sensor located in the thermostat.

A Heat Recovery system consists of an outdoor condensing unit, air handlers in the form of cassettes, distribution Wyes, mode change units (also known as a "remote headers"), optional wall-mounted thermostats, and an optional system controller. Heat Recovery Systems allow for heat from one zone to be transported and utilized in another zone. In this manner, heat from one area of a building can be transported to an area requiring more heat, and cool air from another area of a building can be transported to an area requiring cool air. In this manner, the heat recovery capabilities allow for heating and cooling to occur simultaneously in different parts of the building by the transfer of different temperature air through the system. As with the Heat Pump system, the Heat Recovery system collects data from four points of the system; two points are located at the indoor evaporator coil sensors which are utilized for calculations performed in utilization of an Electronic Expansion Valve (EEV), one point is from a sensor located within the return air, and the final point from a sensor located in the thermostat.

VRF systems target only the temperature of a space and are limited to only heating or cooling and are not capable of dehumidification. Standard VRF systems can only provide heating and cooling operations in the same manner as standard HVAC systems. VRF systems utilized for heat recovery alone cannot achieve any dehumidification.

Some packaged systems which utilize VRF, with coils organized in a highly efficient configuration, can achieve some dehumidification. These packaged systems are all-in-one units which incorporate multiple coils and a modular compressor in a self-contained unit. Even the best of these systems is only able to attain a 52-55% humidity baseline before becoming terribly inefficient. Such packaged systems employ a 2-coil setup wherein the ratio of the main coil to the reheat coil is 100:50. These systems are terribly inefficient as they sacrifice fine-tuning the temperature in order to achieve both heating and cooling. The reheat coil only has half of the capacity of the primary coil and is therefore undersized and the system must constantly switch between heating and cooling in order to attain any de-humidification. As that temperature is achieved, the system switches from one mode to another in order to maintain the temperature. However, this is not always the desired effect. In some cases, a user may desire to keep the system in a heating or cooling mode and utilize the increased heating/cooling for use in other parts of the system or structure. Where increased heating/cooling is desired, the packaged system overshoots in much the same way as the HVAC system and constantly switches between modes in an attempt to maintain the temperature. In this manner, such systems lack the refined control to go between heating and cooling modes as they are programmed to achieve a desired temperature.

Standard VRF systems target the temperature of the air when operating and focus on driving the temperature down. However, these systems lack sufficient data points to process and utilize in order to achieve desired humidity levels in the air by modifying the operation of the system on the fly. Some prototype systems target relative humidity but are unable to achieve an efficient system because relative humidity is a moving target. Relative humidity is the percent of saturation at a given temperature. Stated another way, relative humidity is a measure of the amount of moisture in the air relative to the maximum amount it can hold at that temperature. As air is warmed, its ability to hold water increases. Dew point, on the other hand, is the temperature at which air is saturated with water (100% relative humidity). When the temperature of the air drops to the dew point, condensation begins. For example, if the air is at 100% relative humidity at 60 degrees, and is then warmed to 90 degrees, its relative humidity is said to drop significantly, but its dewpoint remains at 60 degrees. In such a situation, targeting the relative humidity to remove moisture from the air is exceedingly difficult because the air conditioning system is constantly changing and moving the target. Therefore, the standard four data point input from VRF systems is simply not enough to adequately adjust the system to achieve the desired effects of reducing humidity at a desired temperature. For these reasons, standard heat pump and heat recovery systems are not able to adequately dehumidify air to a comfortable level.

Dedicated Outside Air Systems (DOAS) are an alternate option to VRF technology. DOAS utilizes seven data points; two at the indoor cooling evaporator coil utilized for calculations performed in utilization of an EEV, two at the indoor reheat/reclaim evaporator coil utilized for calculations performed in utilization of an EEV, one at the return air (typically at the thermostat), one enthalpy sensor in the fresh air inlet, and one temperature sensor that monitors the supply air. However, very few manufacturers support DOAS because of its inability to perform adequately.

The present invention substantially diverges in design elements from the known art and consequently it is clear that there is a need in the art for an improvement to existing VRF systems. In this regard the present invention substantially fulfills these needs.

SUMMARY OF THE INVENTION

In view of the foregoing disadvantages inherent in the known types of VRF systems now present in the prior art, the present invention provides a VRF dehumidification system wherein the same can be utilized to attain targeted humidity levels within structures as well as maintaining set temperatures. The present VRF dehumidification system comprises at least one condenser module in fluid communication with one or more indoor air handlers. At least one evaporator coil is in fluid communication with the indoor air handlers and at least one reheat/reclaim coil. The evaporator and reheat/reclaim coils are also in communication with the condenser module. A plurality of electronic expansion valves (EEVs) are in fluid communication with the indoor air handlers. A plurality of sensors is disposed in the system and are in communication with at least one VRF dehumidification system controller. In one embodiment, a logic is stored in a non-transitory computer readable medium that, when executed by one or more processors, causes the VRF dehumidification system to monitor the data input from the plurality of sensors and regulates the capacity of the VRF dehumidification system needed to maintain a set dew point parameter.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
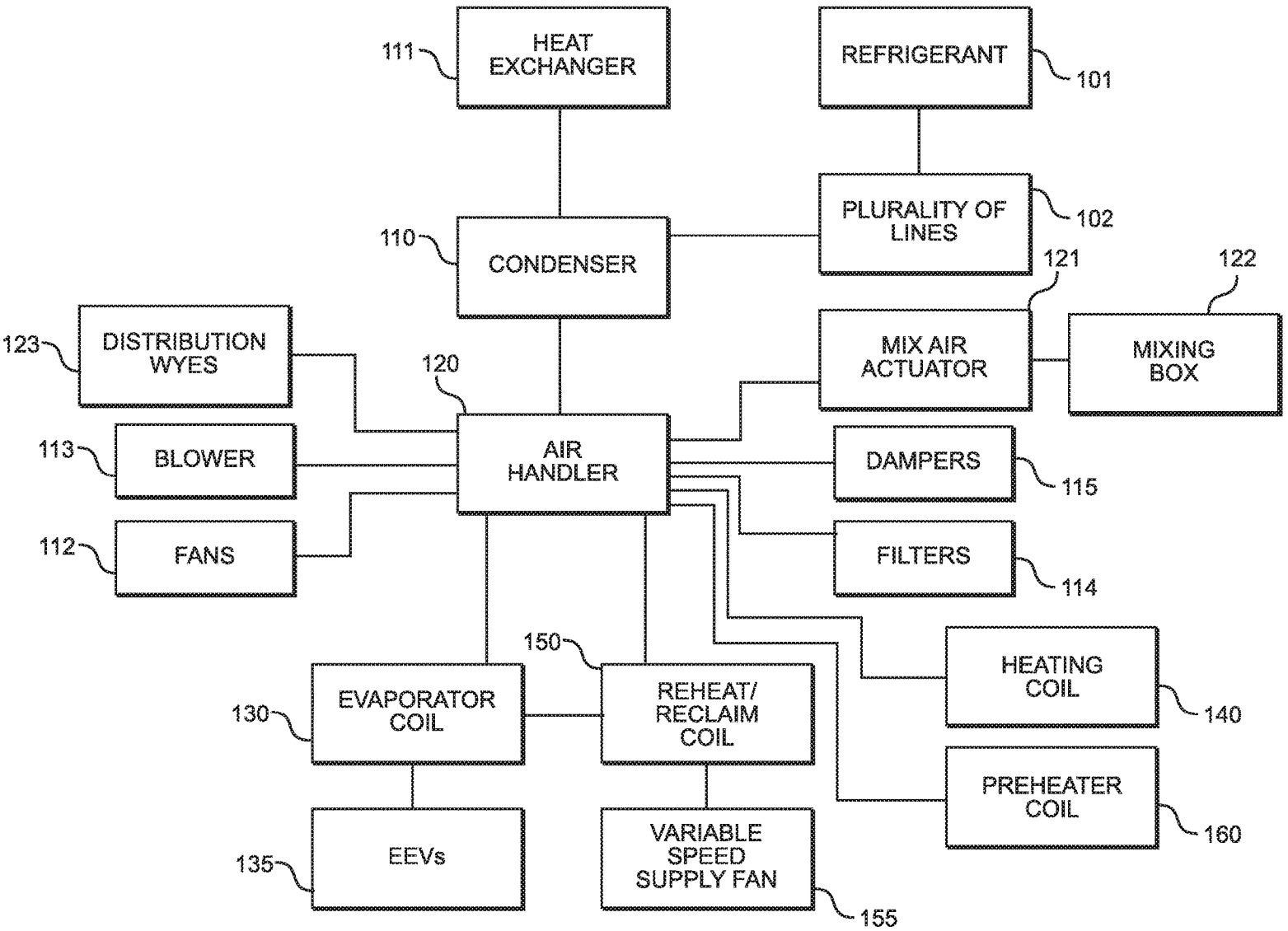
FIG. 1 shows a block diagram of the representative components of the VRF dehumidification system, with a focus on the flow of air through the VRF dehumidification system.

Reference is made herein to the attached drawings. Like reference numerals are used throughout the drawings to depict like or similar elements of the VRF dehumidification system. For the purposes of presenting a brief and clear description of the present invention, a preferred embodiment will be discussed as used for the VRF dehumidification system. The figures are intended for representative purposes only and should not be considered to be limiting in any respect.

As used herein, "logic" refers to (i) logic implemented as computer instructions and/or data within one or more computer processes and/or logic (ii) logic implemented in electronic circuitry. As used herein, "computer readable medium" excludes any transitory signals, but includes any non-transitory data storage circuitry, e.g., buffers, cache, and queues, within transceivers of transitory signals.

It should be understood by one of ordinary skill in the art that although the present disclosure focuses on the dehumidification aspect of the VRF dehumidification system, the VRF dehumidification system is also able to be utilized to customize the amount of moisture in the air at a targeted temperature. Such customization is desirable in a wide range of applications. For example, in greenhouses and growing spaces higher temperatures with higher humidity levels are desirable. In computer server spaces lower temperatures with a base level of humidity is desirable. In supermarkets and convenience stores maintaining lower humidity levels allow the temperature to be maintained at a higher level. This is highly desirable, especially in the summer, as the temperature of the store does not need to fall into the 70-degree range; the stores can be maintained at or above 80 degrees, with lower humidity, and still be comfortable for the patrons therein. This lower humidity translates to less spoilage of the goods in the store and less of a need to replace spoiled goods. The ability to maintain a higher temperature translates into less energy usage to drive the temperature down further. The present invention allows a user to customize the temperature and humidity levels to fit their needs in a given space.

Referring now to FIG. 1, there is shown a plan view of an embodiment of the VRF dehumidification system. The VRF dehumidification system comprises a refrigerant 101, a plurality of lines 102 adapted to transport the refrigerant 101, and at least one condenser 110. One of ordinary skill in the art will understand that the refrigerant 101 is a fluid that is utilized in a heat pump and refrigeration cycle to transport heat from a first medium, such as air, to the refrigerant 101. The refrigerant 101 is a heat carrier and is utilized to transfer heat away from the first medium to a second medium, such as outside air or cold air located elsewhere in the system. The expansion and compression of the refrigerant 101 results in the refrigerant 101 passing between the liquid and gaseous states of matter and the refrigerant 101 transfers heat from the first medium to the second medium through the refrigeration cycle.

The plurality of lines 102 is adapted to transport the refrigerant 101 from one section of the VRF dehumidification system to another. The plurality of lines 102 is insulated such that the temperature of the refrigerant 101 is maintained while traveling in the lines 102. In one embodiment, sections of the plurality of lines 102 comprise an insulating material. In another embodiment, sections of the plurality of lines 102 are enveloped by an insulating material. The insulating material allows the refrigerant 101 to travel inside the lines 102 without a transfer of heat to the space outside of the lines 102, while the un-insulated sections of the plurality of lines 102 allow for heat transfer as is necessitated by various components of the VRF dehumidification system. In various embodiments, the plurality of lines 102 is waterproof, leak-proof, leak-resistant, and comprised of materials that confine the refrigerant 101 to within the lines 102.

The condenser 110 is used to condense the refrigerant 101 from its gaseous to liquid state as is necessitated by the refrigeration cycle. The condenser 110 cools down and condenses refrigerant 101 in its gaseous state to its liquid state and compresses the refrigerant 101 to raise its pressure and move the refrigerant 101 in the plurality of lines 102. A heat-exchanger 111 is utilized to enable the refrigerant 101 to transfer heat from the refrigerant 101 to another medium. A fan 112 for blowing air across the heat-exchanger 111 results in the cooling of the refrigerant 101. In one embodiment, heat is transferred from the refrigerant 101 to air outside a structure in which the VRF dehumidification system is installed. In other embodiments, heat is transferred to colder air inside the structure and is utilized in further stages of the VRF dehumidification system as detailed below.

The VRF dehumidification system further comprises one or more air handlers 120 in fluid communication with the condenser 110. The air handlers 120 are used to regulate and circulate air within the structure in which the VRF dehumidification system is installed. In various embodiments, the air handlers 120 comprise blowers 113, fans 112, evaporator coils 130, heating coils 140, reclaim/reheat coils 150, filters 114, and dampers 115. In various embodiments, the air handlers 120 pass air from inside the structure, air from outside the structure, and a mix thereof, over the heating coil 140 and evaporator coils 130 of the VRF dehumidification system as further detailed below. In various embodiments, the air handlers 120 further incorporate a mix air actuator 121 and a mixing box 122 in order to selectively mix air from outside the structure with air from inside the structure.

In one embodiment a plurality of distribution wyes 123 is in communication with the air handlers 120. The distribution wyes 123 allow for additional air handlers 120 to be added to the VRF dehumidification system and add capacity to the system via a mode change unit by tying multiple ports together.

In various embodiments, a pre-heater coil 160 is in fluid communication with the one or more air handlers 120. The pre-heater coil 160 is utilized to generate extreme temperature differentials between the coils of the VRF dehumidification system. Cooling and dehumidification systems operate at their highest efficiency levels when the difference in temperature between the air and the components of the system are large. Where the air passing through an evaporator coil 130 is warm and very moist, and the leaving air's dew point is high, dehumidification occurs at peak efficiency. For example, air enters the VRF dehumidification system and the temperature of the air is dropped to a temperature far below the dewpoint. The air around the first coil becomes supersaturated and when the temperature is quickly ramped up to high levels, the next coil removes the supersaturated component of the air, thereby shocking the moisture out of the air.

At least one evaporator coil 130 is in fluid communication with the one or more air handlers 120. The evaporator coil 130 is in fluid communication with the plurality of lines 102 and the refrigerant 101. The evaporator coil 130 is colder than the air which is passed over it and therefore reduces the temperature of the air. Heat passes from warm air to colder air, and moisture travels from humid air to dry air. The warmer the air is, the more moisture that it can hold. Therefore, moisture in the air condenses on the colder surface of the evaporator coil 130 in the form of water which is then captured and removed from the air. In various embodiments, the recaptured water is utilized in other systems of the building as "grey water".

As air passes over the evaporator coil 130, the surface thereof being colder than the air, the temperature of the air is lowered as heat from the air flows to the colder surface of the evaporator coil 130. In various embodiments, targeted cold temperatures are utilized to bring the temperature of the air down well below a given dew point. Dew point is the point at which air at a given temperature is 100% saturated with moisture. The warmer air is, the more moisture it can hold. Conversely, the colder air is, the less moisture it can hold. In various embodiments, the targeted temperatures are in the range of 36 to 50 degrees Fahrenheit. In one embodiment, the temperature of the air is lowered to a targeted 38 degrees Fahrenheit. In another embodiment, the temperature of the air is lowered to a targeted 46 degrees Fahrenheit. By bringing the temperature of the air very low, moisture in the air is driven out and is able to be reclaimed as described above.

At least one reheat/reclaim coil 150 is in fluid communication with the evaporator coil 130. In various embodiments, a warming stage is added to the VRF dehumidification system cycle to prevent freezing and/or frost forming on or in the components of the system. The warming stage increases the temperature of the air, by exposing the air to a reheat/reclaim coil. The warming stage occurs after the targeted cold temperature is achieved in order to obtain the maximum benefit of lowering the temperature of the air and driving out the maximum amount of moisture in the air.

In one embodiment, the reheat/reclaim coil 150 is also utilized to drive the temperature of the air to a greatly increased level. In various embodiments, targeted reheat temperatures are in the range of 80 to 105 degrees Fahrenheit. In one embodiment, the targeted reheat temperature is 85 degrees Fahrenheit. In another embodiment, the targeted reheat temperature is 100 degrees Fahrenheit. Such high temperatures are achieved in a short physical span, and a short time span in order to further shock the moisture out of the system. Additionally, warmer temperatures may be more desirable to a user where the humidity levels are low in order to maintain a comfortable environment for the user.

In various embodiments, the reheat/reclaim coil 150 is a custom coil sized specifically for the VRF dehumidification system. The industry standard ratio between the evaporator coil 130 capacity and the reheat/reclaim coil 150 capacity is 100:50. In one embodiment the ratio between the evaporator coil 130 capacity and the reheat/reclaim coil capacity 150 is 100:80. Such an increased capacity ratio provides far greater efficiency than the industry standard. Further, the increased strength of such a custom reheat/reclaim coil 150 provides the system with a mechanism to allow the targeted cold temperature to attain temperatures lower than the industry standard of 48 to 50 degrees Fahrenheit.

In various embodiments, a variable speed supply fan 155 is in fluid communication with the reheat/reclaim coil 150. The variable speed supply fan 155 is able to increase or decrease the speed at which air is passed over the coils thereby aiding in attaining a desired temperature of the air. The variable speed supply fan 155 also introduces the air as supply air back into the interior of the structure.

A plurality of electronic expansion valves (EEVs) 135 are in fluid communication with the evaporator coil 130. EEVs 135 are used in refrigeration systems to precisely control the amount of refrigerant 101 introduced and flowing through the evaporator coil 130. In other embodiments, other types of expansion valves, such as thermal expansion valves, can also be utilized to control the flow of refrigerant 101 into the evaporator coil 130. In various embodiments, the plurality of EEVs 135 are in communication with a system controller, as further detailed below. The system controller communicates to the EEV 135 the amount the EEV 135 should open, thereby allowing a selective amount of refrigerant 101 to flow into the evaporator coil 130. In other embodiments, EEVs 135 are in fluid communication with the at least one reheat/reclaim coil 150 and in fluid communication with the at least one pre-heat coil 160.

Figure 2:
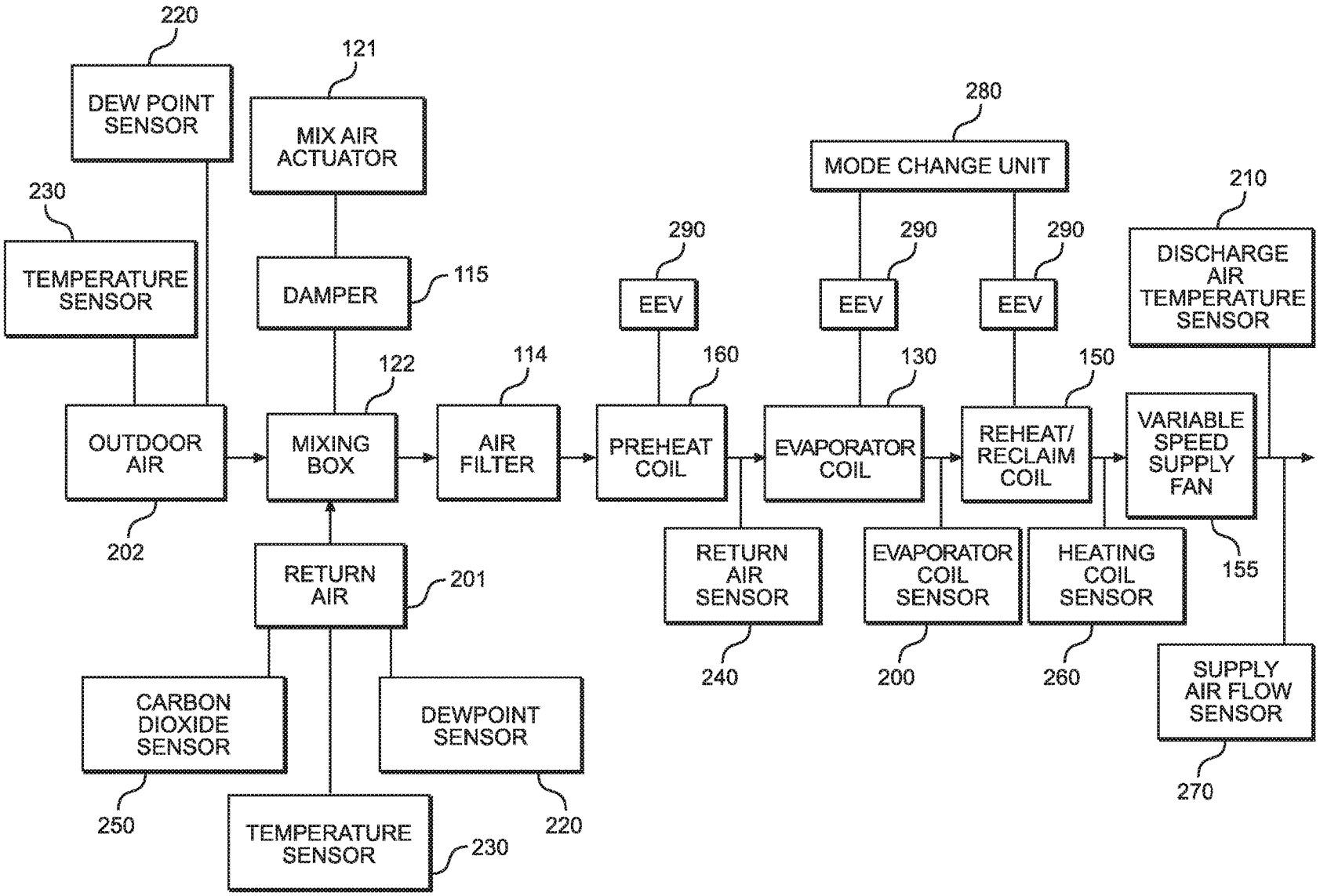
FIG. 2 shows a block diagram of the representative components of the VRF dehumidification system, with a focus on the sensors.

Referring now to FIG. 2, there is shown a block diagram of the representative components of the VRF dehumidification system, with a focus on the sensors. A plurality of sensors is further disposed throughout the VFR dehumidification system including evaporator coil sensors 200, discharge sensors 210, dewpoint sensors 220, temperature sensors 230, and return air sensors 240. The plurality of sensors detects and collects data from various key points in the VFR dehumidification system and communicates with the system controller as further detailed below. In various embodiments, a thermostat is also included in the VFR dehumidification system that further includes at least one sensor and is communication with the system controller. In various embodiments, at least one carbon dioxide sensor 250 is included in the VFR dehumidification system and is in communication with the system controller. In one embodiment, the carbon dioxide sensor 250 is disposed in a position in which it can measure the carbon dioxide levels in return air 201 being drawn into the VRF dehumidification system through a plurality of return vents disposed on the air handlers. In one embodiment, the carbon dioxide sensor 250 works in conjunction with the variable speed supply fan 155 and the air mixture actuator 121. The return air 201 enters the mixing box 122 which is in communication with dampers 115 and at least one mix air actuator 121. Outdoor air 202 also enters the mixing box 122 and combines with the return air 201 to for a mixed air. In some embodiments, an air filter 114 is in communication with the mixing box 122 to filter out undesirable elements before the mixed air is passed to further stages of the VRF dehumidification system.

In one embodiment, the evaporator coil sensors 200 are disposed at least on an inlet and an outlet of the evaporator coil 130. In another embodiment, the evaporator coil sensors 200 are disposed at least on an inlet and an outlet of the reheat/reclaim coil 150. In another embodiment, at least one dewpoint sensor 220 is disposed on a fresh air inlet. In one embodiment, a return air sensor 240 is disposed between the pre-heater coil 160 and the evaporator coil 130. In another embodiment, an evaporator coil sensor 200 is disposed between the evaporator coil 130 and the reheat/reclaim coil 150. In another embodiment, a heating air sensor 260 is disposed between the reheat/reclaim coil 150 and a variable speed supply fan 155. In one embodiment, a supply air flow sensor 270 is disposed after the variable speed supply fan 155. In various embodiments, outdoor temperature sensors 230 and dewpoint sensors 220 are disposed in a position in which they are able to detect and communicate temperature and dewpoint levels of the air outside the structure.

The presence of a wide variety of sensors, distributed at key and strategic points in the VRF dehumidification system, enables the VRF dehumidification system to process and calculate how components of the VRF dehumidification system operate. The system controller is able to collect and process data from the plurality of sensors and thereby control the various components of the VRF dehumidification system as detailed below. The present system includes significantly more sources of data than other systems currently utilize, and therefore the VRF dehumidification system is able to be more efficient and provide better fine-tuned control of temperature and humidity in the structure.

A mode change unit 280 is disposed in communication with the evaporator coil 130 and the reheat/reclaim coil 150. The mode change unit 280 (or "remote header") enables the VRF dehumidification system to switch between four modes of operation; main heat, secondary heat, main cooling, and secondary cooling. Through selective switching of the modes, the VRF dehumidification system controls a plurality of EEVs 290 and therefore the flow of refrigerant into the evaporator coil 130 and reheat/reclaim coils 150. This selective control is utilized to control the temperature of the air and to drive the moisture out of the air, thus accomplishing the desired dehumidification. The mode change unit 280 is in communication with the system controller, as further detailed below, such that the system controller can control the operation of the mode change unit 280.

Figure 3:
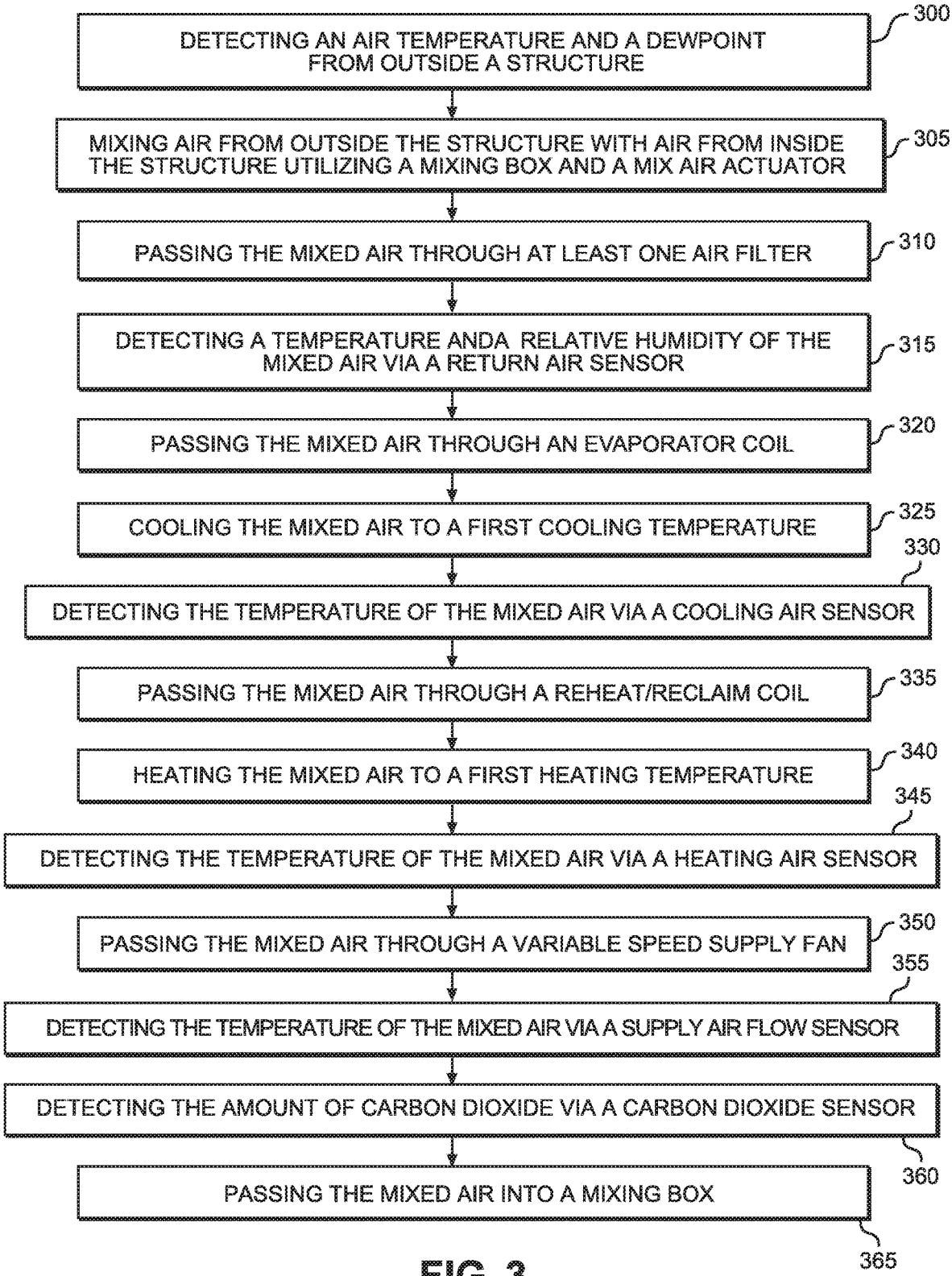
FIG. 3 shows a block diagram of a method for dehumidifying air.

Referring now to FIG. 3, there is shown a block diagram of a method for dehumidifying air. The method of dehumidifying air in a structure comprises the steps of detecting an air temperature and a dewpoint from outside a structure 300. The plurality of sensors, specifically the temperature and dewpoint sensors disposed exterior to the structure, enables the VRF dehumidification system to detect such air temperature and dewpoint readings outside the structure. Air is mixed from outside the structure with air from inside the structure utilizing a mixing box and a mix air actuator 305. The air from inside the structure is obtained via a return in an air handler and air from outside the structure is obtained via a pump. In various embodiments, the air handler comprises a mixing box and a mix air actuator. Air from inside the structure is added to the mixing box and upon activation, the mix air actuator combines the two sources of air into a mixed air. Passing the mixed air through at least one air filter 310 enables the selective filtration of undesirable elements out of the air.

In one embodiment, the method further comprises the step of passing the mixed air through a pre-heater coil. The pre-heater coil selectively increases the temperature of the mixed air to a first pre-heat temperature. Detecting a temperature and a relative humidity of the mixed air is accomplished via a return air sensor 315 disposed between the pre-heater coil and an evaporator coil. Cooling the mixed air to a first cooling temperature 325 by passing the mixed air over the evaporator coil 320 results in the temperature of the mixed air lowering. Upon the temperature of the mixed air being lowered below the dewpoint of the air in the structure, condensation forms on the surfaces of the evaporator coil which are colder than the air. The temperature of the mixed air is detected and communicated to a system controller via a cooling air sensor 330 disposed between the evaporator coil and a reheat/reclaim coil.

Passing the mixed air through a reheat/reclaim coil 335 allows the mixed air to be reheated. Heating the mixed air through a reheat/reclaim coil 340 increases the temperature of the mixed air to a first targeted heating temperature. In one embodiment, the first targeted heating temperature is in the range of 80 to 110 degrees Fahrenheit. The temperature of the mixed air is detected via a heating air sensor 345 disposed between the reheat/reclaim coil and a variable speed supply fan. This temperature is communicated to a system controller. The mixed air is passed through the variable speed supply fan 350, whose speed is controlled by the system controller. In such a manner, the temperature of the mixed air is lowered to a desired temperature and the mixed air is reintroduced into the interior of the structure as supply air. The temperature of a return air is detected via a return air flow sensor 355 disposed in a return operatively connected to the air handler. This return air temperature is communicated to the system controller. In one embodiment, the method further comprises the step of detecting an amount of carbon dioxide in the return air via a carbon dioxide sensor 360. In such an embodiment, the carbon dioxide sensor is in operable connection with the mix air actuator and the system controller to bring the carbon dioxide levels within a safe tolerance. The return air is passed into the mixing box 365 and combined with outside air.

Figure 4:
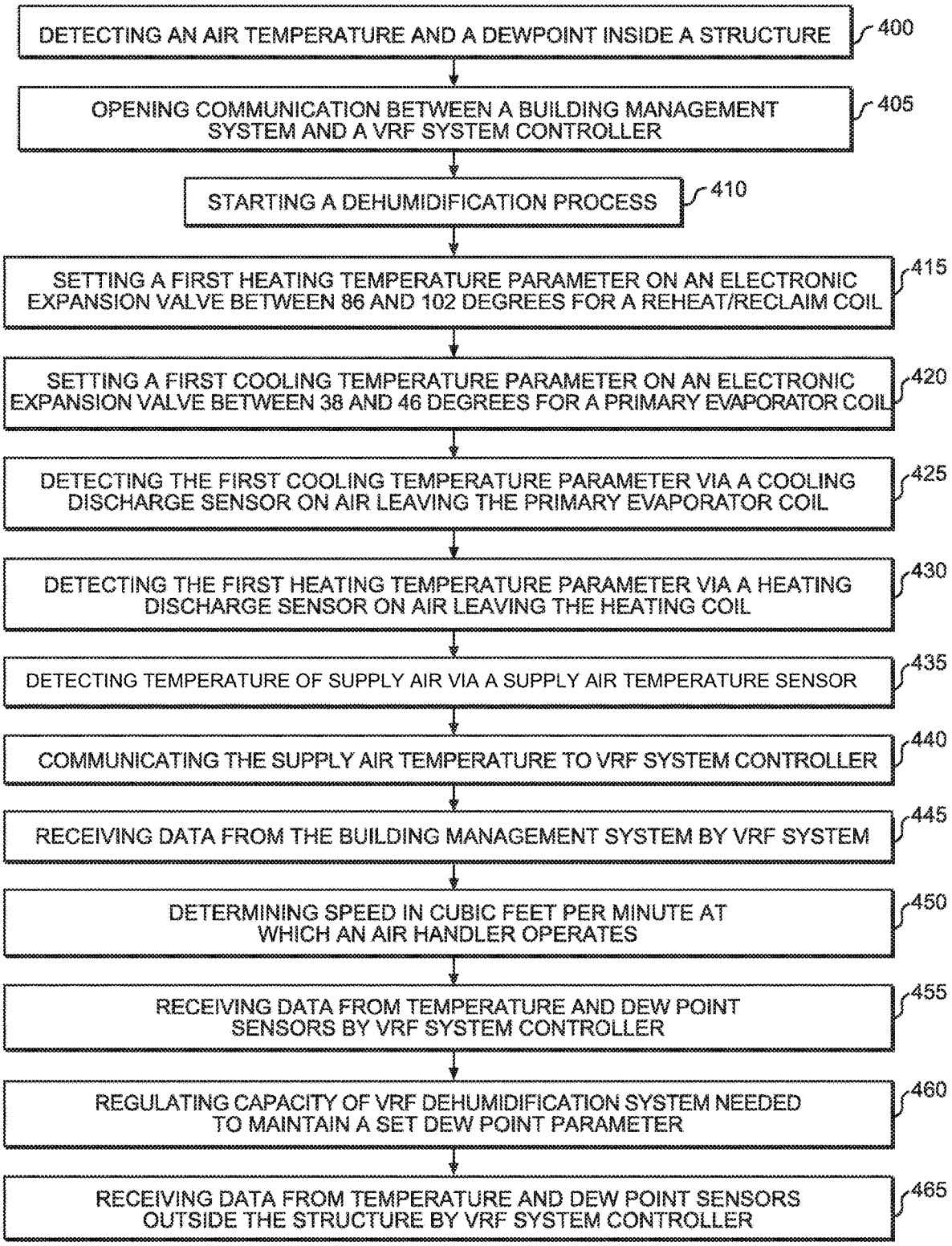
FIG. 4 shows a block diagram of a method for controlling a VRF dehumidification system.

Referring now to FIG. 4, there is shown a block diagram of a method for controlling a VRF dehumidification system. The method for controlling the VRF dehumidification system comprises the steps of detecting an air temperature and a dewpoint inside a structure via temperature and dewpoint sensors disposed inside the structure 400. Communication is opened between a building management system and a system controller 405 when the building management system detects that dehumidification is needed. The dehumidification process starts 410 by implementing pre-programmed EEV parameters by the system controller. The system controller sets a first heating temperature parameter on an EEV connected to a reheat/reclaim coil to between 86 and 102 degrees 415. The system controller sets a first cooling temperature parameter on an EEV connected to an evaporator coil to between 38 and 46 degrees 420.

A cooling discharge sensor detects the first cooling temperature parameter 425. The cooling discharge sensor is in communication with air leaving the evaporator coil. A heating discharge sensor detects the first heating temperature parameter 430. The heating discharge sensor is in communication with air leaving the heating coil. The temperature of supply air is detected via a supply air temperature sensor 435 in communication with the supply air. In one embodiment, the method further comprises the step of detecting a carbon dioxide level in order to determine and set an actuator mechanical damper in the air mixing system. The building management system communicates data to the system controller 440. The system controller receives 445 and utilizes the data to determine and adjust the speed in cubic feet per minute at which the air handler operates 450. Data is also received by the system controller from temperature and dewpoint sensors disposed throughout the VRF dehumidification system 455. The capacity of the VRF dehumidification system is regulated by the system controller based on the needed parameters to maintain a set dew point 460. These parameters are determined by the processing of data communicated between the system controller and the various components of the VRF dehumidification system. Data from temperature and dew point sensors disposed outside the structure is received 465 and further taken into account and processed by the system controller in determining the amount of dehumidification that needs to occur within the structure.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for controlling a variable refrigerant flow dehumidification system, the method comprising:

detecting an air temperature using an air temperature sensor;

detecting a dewpoint inside a structure using a dewpoint sensor;

transmitting data including the air temperature and the dewpoint between the air temperature sensor and the dewpoint sensor and a system controller;

initiating a dehumidification process in response to the air temperature and the dewpoint using the system controller, the system controller including logic to execute instructions including:

setting a first heating temperature parameter on an electronic expansion valve between 86 and 102 degrees for a reheat/reclaim coil; and setting a first cooling temperature parameter on an electronic expansion valve between 38 and 46 degrees for a primary evaporator coil;

detecting the first cooling temperature parameter via a cooling discharge sensor on air leaving the primary evaporator coil;

detecting the first heating temperature parameter via a heating discharge sensor on air leaving the reheat/reclaim coil;

detecting a temperature of supply air via a supply air temperature sensor;

communicating the supply air temperature to the system controller;

receiving data from a building management system by the system controller;

adjusting a speed of an air handler by the system controller;

further detecting the air temperature using the air temperature sensor and further detecting the dewpoint inside using the dewpoint sensor, and transmitting data including the further detected air temperature and the dewpoint to the system controller;

detecting an outside air temperature using an outside air temperature sensor located outside the structure; and detecting an outside dewpoint using an outside dewpoint sensor located outside the structure;

transmitting data including the outside air temperature and the outside dewpoint between the outside air temperature sensor and the outside dewpoint sensor and the system controller; and regulating capacity of the dehumidification system to maintain a set dew point parameter in response to the further detected air temperature and the further detected dewpoint and the data including the outside air temperature and the outside dewpoint.

* * * * *